US007253825B2

(12) United States Patent
Kim et al.

(10) Patent No.: US 7,253,825 B2
(45) Date of Patent: Aug. 7, 2007

(54) PANEL DRIVING METHOD AND APPARATUS FOR REPRESENTING GRADATION

(75) Inventors: Jin-Sung Kim, Cheonan (KR); Jin-Boo Son, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 730 days.

(21) Appl. No.: 10/771,340

(22) Filed: Feb. 5, 2004

(65) Prior Publication Data

US 2004/0160392 A1 Aug. 19, 2004

(30) Foreign Application Priority Data

Feb. 18, 2003 (KR) ..... 10-2003-0010040

(51) Int. Cl.
*G09G 5/10* (2006.01)

(52) U.S. Cl. ..... 345/690; 345/60; 345/63; 345/89; 345/204

(58) Field of Classification Search ..... 345/60–69, 345/87–90, 204–215, 690–699
See application file for complete search history.

(56) References Cited

U.S. PATENT DOCUMENTS 5,541,618 A 7/1996 Shinoda ..... 345/60
2005/0035935 A1* 2/2005 Kang et al. ..... 345/87

FOREIGN PATENT DOCUMENTS

JP 2001-184022 3/2004

* cited by examiner

*Primary Examiner*—Vijay Shankar
(74) *Attorney, Agent, or Firm*—H.C. Park & Associates, PLC

(57) ABSTRACT

A method and an apparatus for driving an image display device, such as, a plasma display panel, to represent a gradation. The pixels of a panel are classified into a plurality of groups, and one frame period is divided with time into n subfields. An address period and a sustain period are sequentially executed on each of the groups during at least two of the n subfields. While the pixels of one group are undergoing an address period during a subfield, the pixels of the other groups remain idle. While the pixels of one group are undergoing a sustain period, the pixels of groups that have already been addressed also undergo the sustain period. During one subfield, different gradation weights are allocated to the groups. A gradation of visual brightness for each pixel is determined by performing an address period for either all or some of the groups during at least two subfields. The panel driving method for representing gradation is adaptable.

15 Claims, 8 Drawing Sheets

| | SF1 | SF2 | SF3 | TOTAL |
|---|---|---|---|---|
| G1 | 4 | 1 | 2 | 7 |
| G2 | 2 | 4 | 1 | 7 |
| G3 | 1 | 2 | 4 | 7 |

| | SF1 | SF2 | SF3 | SF4 | TOTAL |
|---|---|---|---|---|---|
| G1 | 8 | 1 | 2 | 4 | 15 |
| G2 | 4 | 8 | 1 | 2 | 15 |
| G3 | 2 | 4 | 8 | 1 | 15 |
| G4 | 1 | 2 | 4 | 8 | 15 |

| | SF2 | SF3 | SF4 | TOTAL |
|---|---|---|---|---|
| G1 | 8 | 2 | 4 | 14 |
| G2 | 4 | 8 | 2 | 14 |
| G3 | 2 | 4 | 8 | 14 |

PANEL DRIVING METHOD AND APPARATUS FOR REPRESENTING GRADATION

BACKGROUND OF THE INVENTION

This application claims the priority of Korean Patent Application No. 2003-10040, filed on Feb. 18, 2003, in the Korean Intellectual Property Office, the disclosure of which is incorporated herein in its entirety by reference.

1. Field of the Invention

The invention relates to a method and apparatus of driving an image display device, such as, a plasma display panel (PDP) for representing gradation on the image display device.

2. Description of the Related Art

FIG. 1 shows a conventional method of gradationally driving a panel. The conventional method of FIG. 1 is disclosed in U.S. Pat. No. 5,541,618. A panel driving time can be divided into a reset (initialization) period, an address (writing) period, and a sustain (display) period. During the reset period (not shown), each cell of the panel is initialized to facilitate smooth cell addressing. In FIG. 1, the address periods are indicated by a dotted area and during the address periods wall charges are accumulated on the cells which are to be lit later. The sustain periods are indicated by hatched areas and during the sustain period discharging occurs to display a picture on the addressed cells.

As shown in FIG. 1, to achieve gradation with a frame-subfield structure, separate address periods and sustain periods are driven independently over time. In other words, during each subfield, after all of the scan electrodes, Y1 to Yn, are completely addressed, all pixels undergo sustaining simultaneously.

Accordingly, when gradation is achieved according to such a conventional panel-driving method, a significant time gap may exist between the time when a cell undergoes addressing and the time when the cell undergoes sustain discharging. This leads to unstable sustain discharging.

SUMMARY OF THE INVENTION

The invention provides a panel driving method and apparatus for achieving gradation with smooth sustain discharging by minimizing a time gap between an address period and a sustain period.

According to an aspect of the invention, there is provided a panel driving method in which, to represent a gradation for each cell, pixels of a panel are classified into a plurality of groups, one frame period is divided with time into n subfields, an address period and a sustain period sequentially occur during each of the subfields, and n gradation weights W1 through Wn (where n is an integer equal to or greater than 2) are allocated to the sustain periods in the n subfields, respectively. In this panel driving method, during one subfield, any one of the n weights is assigned to each of the groups except when all of the weights allocated to the groups are the same, and during one frame, the n weights are assigned to the n subfields in each group, respectively. While the pixels of one group are undergoing an address period during a subfield, the pixels of the other groups remain idle, and while the pixels of one group are undergoing a sustain period, the pixels of groups that have already been addressed also undergo the sustain period, and a gradation for each pixel is determined according to gradation weights allocated to the addressed subfields by selectively performing an address period with respect to individual groups.

According to another aspect of the invention, there is provided a panel driving apparatus including a subfield processor, a signal synthesis unit, and a pixel driving unit. The subfield processor divides one frame into a plurality of subfields and allocates different gradation weights to a plurality of groups into which the pixels of a panel are classified, during each subfield, while gradation weights allocated to the groups during one frame are the same. The signal synthesis unit generates an address signal for addressing only pixels to be lit later among the pixels and a sustain signal for sustain-discharging the addressed pixels. The address signal and the sustain signal are applied during each of the subfields. The pixel driving unit selectively drives the pixels of the groups during each subfield depending on the address and sustain signals output from the signal synthesis unit, to thereby determine a gradation of visual brightness of each of the pixels. While executing an address period on the pixels of one group during a subfield, the signal synthesis unit renders the pixels of the other groups to be idle. While executing a sustain period on the pixels of one group, the signal synthesis unit executes a sustain period on the pixels of groups that have already been addressed. The signal synthesis unit determines a gradation for each pixel according to gradation weights allocated to the addressed subfields by selectively performing an address period with respect to the individual groups.

BRIEF DESCRIPTION OF THE DRAWINGS

The above and other features and advantages of the invention will become more apparent by describing in detail exemplary embodiments thereof with reference to the attached drawings.

DETAILED DESCRIPTION OF THE INVENTION

The invention will now be described in more detail with reference to a method of driving an AC-type plasma display panel (PDP) according to an exemplary embodiment of the invention.

Figure 7:
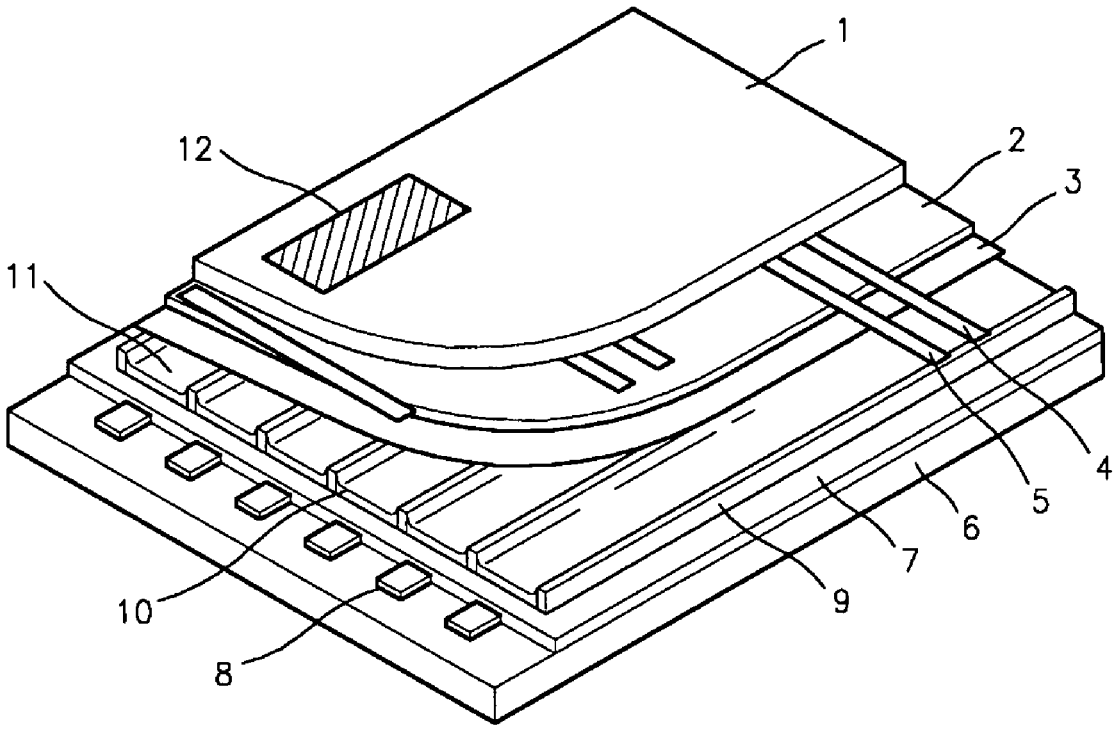
FIG. 7 is a perspective view of a part of an AC type plasma display panel.

FIG. 7 is a perspective view of a part of an AC type PDP. Pairs of a scan electrode 4 and a sustain (common) electrode 5, which are covered with a dielectric layer 2 and a protective layer 3, are installed in parallel on a first glass substrate 1. A plurality of address electrodes 8, which are covered with an insulative layer 7, are installed on a second glass substrate 6. Barrier ribs 9 stand on portions of the insulative layer 7 between adjacent address electrodes 8 and are substantially parallel with the address electrodes 8. Phosphors 10 are provided on the exposed surface of the insulative layer 7 and on both side faces of the barrier ribs 9. The resultant first and second glass substrates 1 and 6 are positioned opposing each other with a discharge space 11 sandwiched therebetween and such that the scan electrodes 4 and the sustain electrodes 5 are substantially orthogonal to the barrier ribs 9 and the address electrodes 8. A discharge cell 12 is formed between two adjacent barrier ribs 9 at the intersection of an address electrode 8 and a pair of the scan electrode 4 and the sustain electrode 5.

Figure 8:
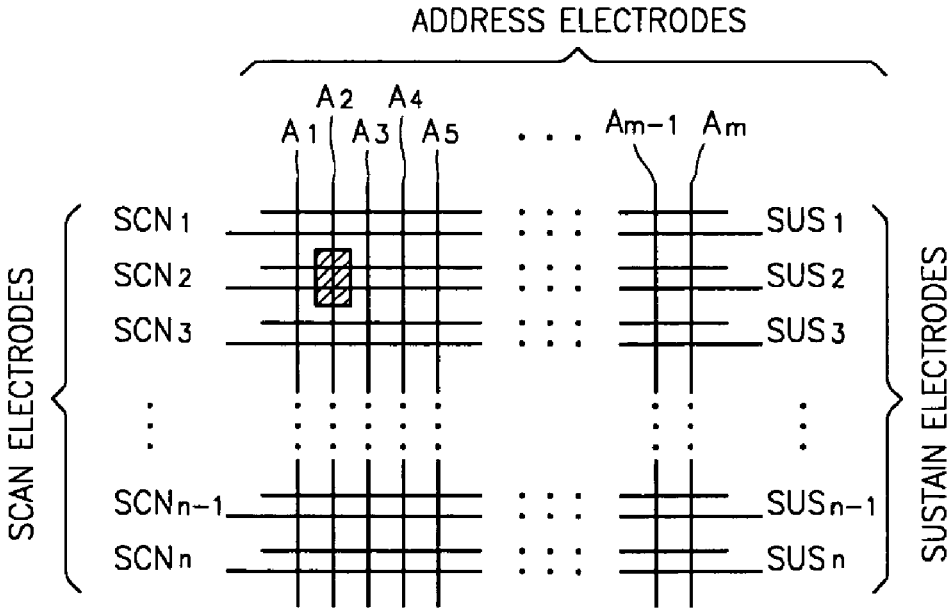
FIG. 8 is an exemplary arrangement diagram of electrodes of a panel.

FIG. 8 is an exemplary arrangement diagram of the electrodes of a panel. The electrodes are arranged in an m×n matrix. Address electrodes $A_1$ through $A_m$ are arranged in a column direction, and n scan electrodes $SCN_1$ through $SCN_n$ and n sustain electrodes $SUS_1$ through $SUS_n$ are arranged in a row direction. A discharge cell (hatched portion) of FIG. 8 corresponds to the discharge cell 12 of FIG. 7.

Figure 9:
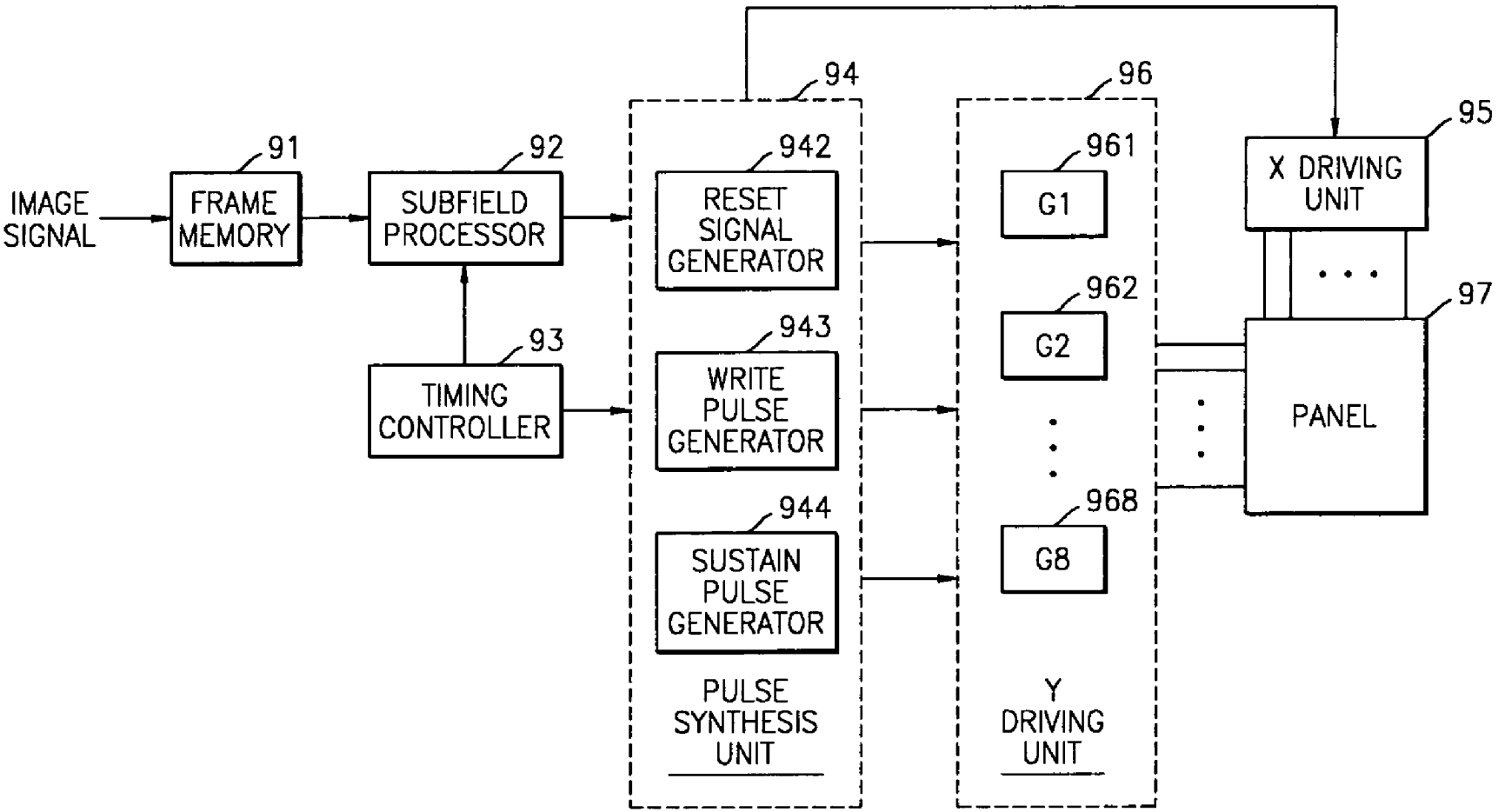
FIG. 9 is a block diagram of a panel driving apparatus according to an exemplary embodiment of the invention.

FIG. 9 is a block diagram of a panel driving apparatus according to an exemplary embodiment of the invention. An analog image signal to be displayed on a panel 97 is converted into digital data, and the digital data of a single frame is recorded in a frame memory 91. A subfield processor 92 divides a single frame of the digital data stored in the frame memory 91 into a plurality of subframes as needed, and outputs the digital data on a subfield-by-subfield basis.

To drive the address electrodes, the scan electrodes, and the sustain electrodes that form the pixels of the panel 97, a pulse synthesis unit 94 generates signal waveforms to be applied to the electrodes during a reset period, an address period, and a sustain period. The pulse synthesis unit 94 includes a reset signal generator 942, a write pulse generator 943, and a sustain pulse generator 944. The reset signal generator 942 generates a reset signal for initializing the state of each cell. The write pulse generator 943 generates an address signal for addressing the cells that are to be lit later. The sustain pulse generator 944 generates a sustain signal used to discharge cells that have been addressed by the address signal. The signals generated by the pulse synthesis unit 94 are applied to a Y driving unit 96 and an X driving unit 95 in synchronization with a predetermined timing. The Y driving unit 96 drives the scan electrodes of the panel 97, and the X driving unit 95 drives the sustain electrodes of the panel 97.

The scan electrodes of the panel 97 are classified into a plurality of groups. The Y driving unit 96 includes a plurality of driving circuits 961, 962, . . . , and 968 for driving the scan electrodes in the groups G1, G2, . . . , and G8. A timing controller 93 generates various timing signals required upon the operations of the subfield processor 92 and the pulse synthesis unit 94. A method of providing gradation by driving the electrodes of a panel using the panel driving apparatus of FIG. 9 will be described in detail below.

Generally, a period of one frame that forms one picture is divided into a plurality of subfields, each of which is assigned different grades. A desired gradation level can be achieved by driving at least one subfield selected from the plurality of subfields.

Typically, gradation of visual brightness, i.e., a gray scale, is proportional to the number of sustain pulses applied to cells during one frame. One frame corresponding to one picture is divided with time into a plurality of subfields, to which different numbers of sustain pulses are allocated. Then, some of the subfields are selectively operated, so that gradation is determined by accumulation of the sustain pulses allocated to the selected subfields.

Figure 1:
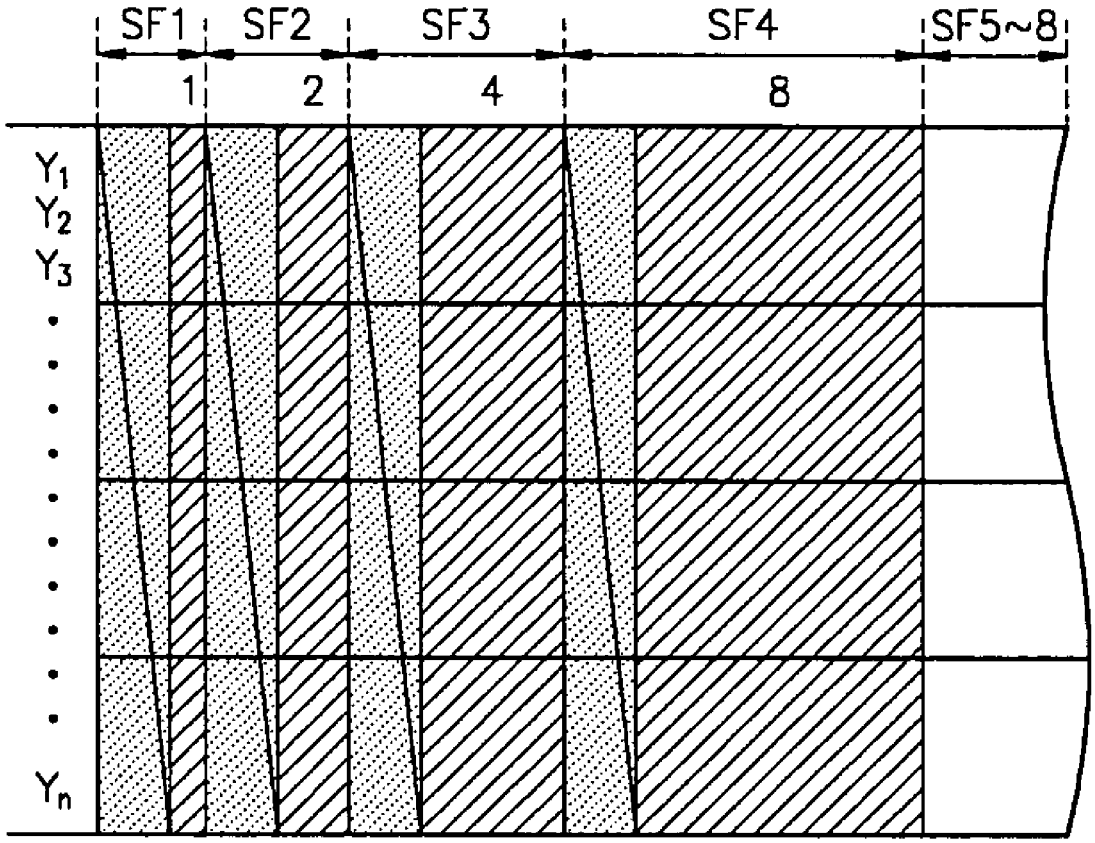
FIG. 1 (PRIOR ART)
FIG. 1 illustrates a conventional method of driving a panel to achieve gradation.

One frame is typically divided into 8 subfields to achieve 256 grades. Different numbers of sustain pulses are allocated to the 8 subfields at a ratio of 1:2:4:8:16:32:64:128. A sustain period for each subfield is determined in approximate proportion to this ratio. FIG. 1 shows an example in which one frame is divided into 8 subfields in order to achieve 256 grades. For example, with such a distribution of sustain pulses, to obtain a brightness of 17 grades, cells can be addressed and sustain-discharged only during first and fifth subfields SF1 and SF5.

A gradation weight allocated to each subfield may vary depending on gamma characteristics or panel characteristics. For example, a gradation weight allocated to the fourth subfield SF4 may be lowered from 8 to 6, and a gradation weight allocated to the sixth subfield SF6 may be increased from 32 to 34. Also, the number of subfields that form one frame may vary according to a design specification.

To accomplish a panel driving method according to the invention, the pixels of a panel are classified into a plurality of groups, and the operations of the groups are independently controlled. Instead of allocating the same gradation weight to the pixels during one subfield, generally, different gradation weights are allocated to different groups. In the case of AC type PDPs, scan electrodes may be classified into a plurality of groups according to a predetermined way, which will now be described in detail.

Figures 2A, 2B:
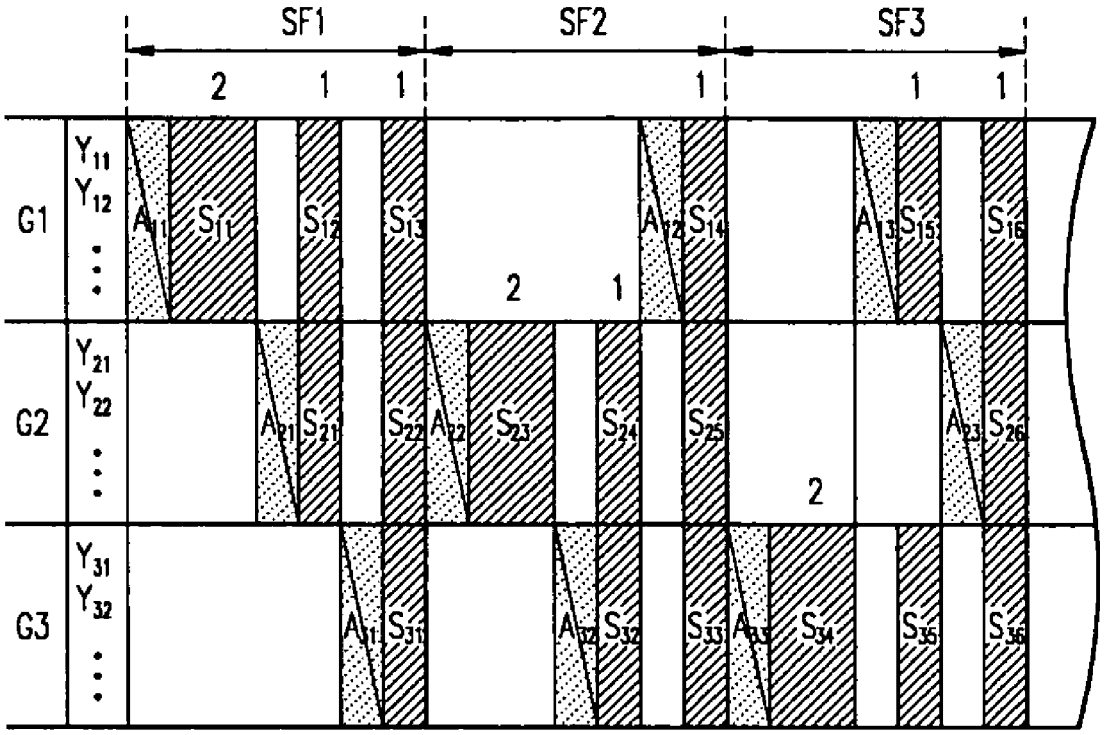
FIG. 2A illustrates a method of driving a panel to achieve gradation, according to an exemplary embodiment of the invention.
FIG. 2B is a table showing examples of various grade levels that can be produced by three subfields of FIG. 2A.

FIG. 2A illustrates a method of driving a panel in order to provide gradation, according to an exemplary embodiment of the invention. In the panel driving method of FIG. 2A, 8 grades, i.e., grades 0 through 7, are obtained using three subfields.

The scan electrodes of a panel are classified into a plurality of groups G1 through Gn, which are sequentially addressed. After one group is addressed, sustain discharge pulses are applied to the scan electrodes of the group to execute a sustain period. While the pixels of one group are undergoing a sustain period, the pixels of other groups that have already been addressed also undergo a sustain period. In other words, after an address period and a sustain period are executed on the pixels of one group, another address period and another sustain period are executed on the pixels of the next group. While the pixels of one group are undergoing an address period, the pixels of other groups are kept idle. While the pixels of one group are undergoing a sustain period, the pixels of other groups that have already been addressed also undergo a sustain period.

In FIG. 2A, a dotted block indicates an address period, and a hatched block indicates a sustain period. Before an address period, a reset period occurs to initialize the wall discharge state of each pixel. All of the groups may undergo a reset period at the same time by concurrently applying reset pulses to the groups. Alternatively, reset periods may occur individually on the groups.

As shown in FIG. 2A, when three subfields SF1 through SF3 are used in a panel driving method according to the invention, the pixels of a panel is classified into three groups G1, G2, and G3. In the conventional panel-driving method of FIG. 1, gradation weights of 1, 2, and 4 are allocated to the first, second, and third subfields SF1 through SF3, respectively. In the example of FIG. 2A, one subfield includes three sustain periods to which gradation weights of 1, 1, and 2 are allocated, respectively. An address period and a sustain period during each subfield will now be described in detail with reference to FIG. 2A.

In the first subfield SF1, the groups sequentially undergo a series of an address period and a sustain period. The pixels of the first group G1 (i.e., pixels connected to scan electrodes $Y_{11}$, $Y_{12}$, . . . ) are sequentially addressed in units of the pixels coupled to each scan electrode to execute an address period $A_{11}$. When the address period $A_{11}$ for the first group G1 is terminated, a first sustain period $S_{11}$ is executed so that the addressed pixels of the first group G1 are discharged. A gradation weight of 2 is allocated to the first sustain period $S_{11}$. This means that, if a panel wants to represent 256 grades, brightness of 2 with respect to the greatest brightness of 256 is displayed by the discharge occurring during the first sustain period $S_{11}$. Assuming that grade 1 can be achieved using three sustain pulses, 6 sustain pulses will be applied during the first sustain period $S_{11}$ in order to achieve grade 2.

After the first sustain period $S_{11}$ is completed, an address period $A_{21}$ occurs on the pixels of the second group G2. During the address period $A_{21}$, the pixels of the first group G1 are kept idle. After all of the pixels of the second group G2 have been completely addressed during the address period $A_{21}$, second sustain periods $S_{12}$ and $S_{21}$ occur on the pixels of the first and second groups G1 and G2, respectively. A gradation weight of 1 is allocated to each of the second sustain periods $S_{12}$ and $S_{21}$. Accordingly, the pixels of the first group G1 that have been addressed during the address period $A_{11}$ and discharged during the first sustain period $S_{11}$, and the pixels of the second group G2 addressed during the address period $A_{21}$ are discharged with brightness corresponding to the gradation weight of 1.

After the second sustain periods $S_{12}$ and $S_{21}$ are completed, an address period $A_{31}$ occurs on the pixels of the third group G3. During the address period $A_{31}$, the pixels of the first and second groups G1 and G2 are kept idle. After all of the pixels of the third group G3 have been completely addressed during the address period $A_{31}$, third sustain periods $S_{13}$, $S_{22}$, and $S_{31}$ occur on the pixels of the first, second, and third groups G1, G2, and G3, respectively. A gradation weight of 1 is allocated to each of the third sustain periods $S_{13}$, $S_{22}$, and $S_{31}$.

Accordingly, when the first subfield SF1 is terminated, the addressed pixels of the first group G1 display grade 4, the addressed pixels of the second group G2 display grade 2, and the addressed pixels of the third group G3 display grade 1, as shown in FIG. 2B.

The first subfield SF1 is followed by the second subfield SF2. The second subfield SF2 starts with an address period $A_{22}$ with respect to the pixels of the second group G2. Then, the pixels of the second group G2 undergo a first sustain period $S_{23}$. During the address period $A_{22}$ and the first sustain period $S_{23}$, pixels other than the second group G2 are kept idle. Thereafter, the pixels of the third group G3 undergo an address period $A_{32}$, and then the pixels of the second and third groups G2 and G3 substantially simultaneously undergo second sustain periods $S_{24}$ and $S_{32}$, respectively. Next, an address period $A_{12}$ occurs on the pixels of the first group G1, and then three sustain periods $S_{14}$, $S_{25}$, and $S_{33}$ occur substantially simultaneously on the pixels of the first, second, and third groups G1, G2, and G3, respectively. The first, second, and third sustain periods are assigned gradation weights of 2, 1, and 1, respectively.

Accordingly, when the second subfield SF2 is completed, the addressed pixels of the first group G1 display grade 1, the addressed pixels of the second group G2 display grade 4, and the addressed pixels of the third group G3 display grade 2, as shown in FIG. 2B.

The second subfield SF2 is followed by the third subfield SF3. The third subfield SF3 starts with an address period $A_{33}$ and a first sustain period $S_{34}$ with respect to the pixels of the third group G3. While the pixels of the third group G3 are undergoing the address period $A_{33}$ and the first sustain period $S_{34}$, other group pixels are kept idle. Thereafter, the pixels of the first group G1 undergo an address period $A_{13}$, and then the pixels of the first and third groups G1 and G3 substantially simultaneously undergo second sustain periods $S_{15}$ and $S_{35}$, respectively. Next, an address period $A_{23}$ occurs on the pixels of the second group G2, and then three sustain periods $S_{16}$, $S_{26}$, and $S_{36}$ substantially simultaneously occur on the pixels of the first, second, and third groups G1, G2, and G3, respectively. The first, second, and third sustain periods are assigned gradation weights of 2, 1, and 1, respectively.

Accordingly, when the third subfield SF3 is completed, the addressed pixels of the first group G1 display grade 2, the addressed pixels of the second group G2 display grade 1, and the addressed pixels of the third group G3 display grade 4, as shown in FIG. 2B.

Referring to FIG. 2B, when three subfields are used, 8 grades, i.e., grades 0 through 7, can be obtained. In order to obtain one of grades 0 to 7 during the three subfields SF1 through SF3, address periods for the groups G1 through G3 may be selectively performed during each subfield.

For example, in order to obtain grade 5 during the subfields SF1 through SF3, only the first and third groups G1 and G3 undergo address periods during the first subfield SF1, only the first and second groups G1 and G2 undergo address periods during the second subfield SF2, and only the second and third groups G2 and G3 undergo address periods during the third subfield SF3. In other words, pixels of the first group G1 that are to be lit later are addressed and sustain-discharged during only the first and second subfields SF1 and SF2. Pixels of the second group G2 that are to be lit later are addressed and sustain-discharged during only the second and third subfields SF2 and SF3. Pixels of the third group G3 that are to be lit later are addressed and sustain-discharged during only the first and third subfields SF1 and SF3. In this way, brightness of grade 5 is obtained using the first through third subfields SF1 through SF3.

Figure 3A:
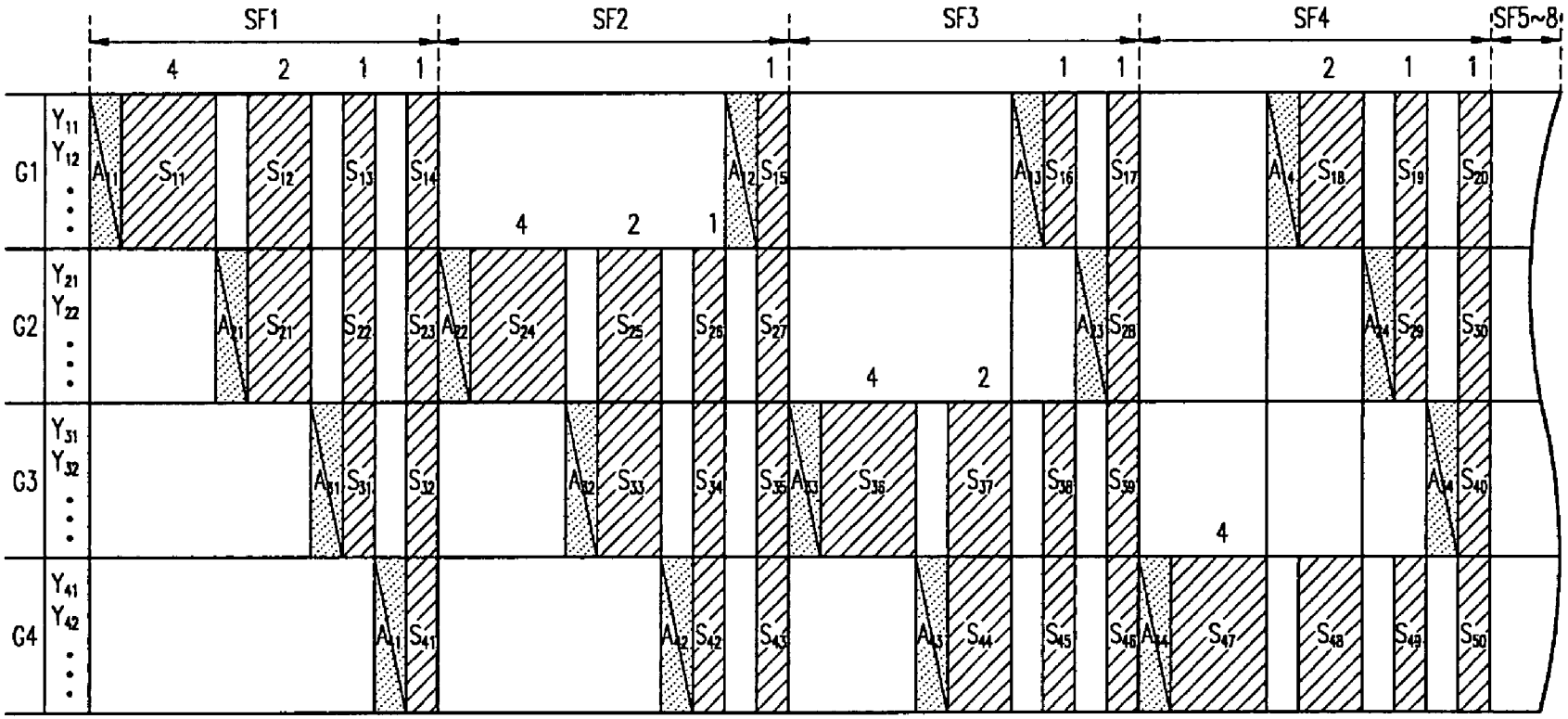
FIG. 3A illustrates a method for achieving 16 grades using four subfields.

FIG. 3A illustrates a method of achieving 16 grades, which are grades 0 through 15, using four subfields. In a conventional method as shown in FIG. 1, to achieve 16 grades using four subfields, the subfields SF1 through SF4 are assigned different weights so as to achieve grades 1, 2, 4, and 8, respectively. In the panel driving method according to the invention, different gradation weights are allocated to the respective groups during each subfield. During each subfield, a maximum of 4 sustain periods occur depending on the group. The four sustain periods are assigned adequate weights so that they represent grades 1, 1, 2, and 4.

During the first subfield SF1, an address period $A_{11}$ occurs on the pixels of the first group G1 and is followed by a first sustain period $S_{11}$ on the same pixels. Next, an address period $A_{21}$ occurs on the pixels of the second group G2 and is followed by a second sustain period $S_{21}$ on the same pixels. During the second sustain period $S_{21}$, a second sustain period $S_{12}$ also occurs on the pixels of the first group G1.

Thereafter, an address period $A_{31}$ occurs on the pixels of the third group G3 and is followed by a third sustain period $S_{31}$ on the same pixels. During the third sustain period $S_{31}$, third sustain periods $S_{13}$ and $S_{22}$ also occur substantially simultaneously on the pixels of the first and second groups G1 and G2, respectively.

Finally, an address period $A_{41}$ occurs on the pixels of the fourth group G4 and is followed by a fourth sustain period $S_{41}$ on the same pixels. During the fourth sustain period $S_{41}$, fourth sustain periods $S_{14}$, $S_{23}$, and $S_{32}$ also occur substantially simultaneously on the pixels of the first, second, and third groups G1, G2, and G3, respectively.

The first subfield SF1 is followed by the second subfield SF2. During the second subfield SF2, address periods $A_{22}$, $A_{32}$, $A_{42}$, and $A_{12}$ occur on the pixels of the groups G1 through G4 in the sequence of the groups G2, G3, G4, to G1. Sustain periods $S_{24}$, $S_{33}$, $S_{42}$, and $S_{15}$ follow the address periods $A_{22}$, $A_{32}$, $A_{42}$, and $A_{12}$ and are assigned gradation weights of 4, 2, 1, and 1, respectively.

Similarly, the second subfield SF2 is followed by the third subfield SF3. during the third subfield SF3, address periods $A_{33}$, $A_{43}$, $A_{13}$, and $A_{23}$ occur on the pixels of the groups G1 through G4 in the sequence of G3, G4, G1, to G2. Sustain periods $S_{36}$, $S_{44}$, $S_{16}$, and $S_{28}$ to which gradation weights of 4, 2, 1, and 1 are assigned, respectively, follow the address periods $A_{33}$, $A_{43}$, $A_{13}$, and $A_{23}$, respectively. The third subfield SF3 is followed by the fourth subfield SF4. During the fourth subfield SF4, address periods $A_{44}$, $A_{14}$, $A_{24}$, and $A_{34}$ occur on the pixels of the groups G1 through G4 in the sequence of G4, G1, G2, to G3. Sustain periods $S_{47}$, $S_{18}$, $S_{29}$, and $S_{40}$ to which gradation weights of 4, 2, 1, and 1 are assigned, respectively, follow the address periods $A_{44}$, $A_{14}$, $A_{24}$, and $A_{34}$, respectively.

Figures 3B, 4:
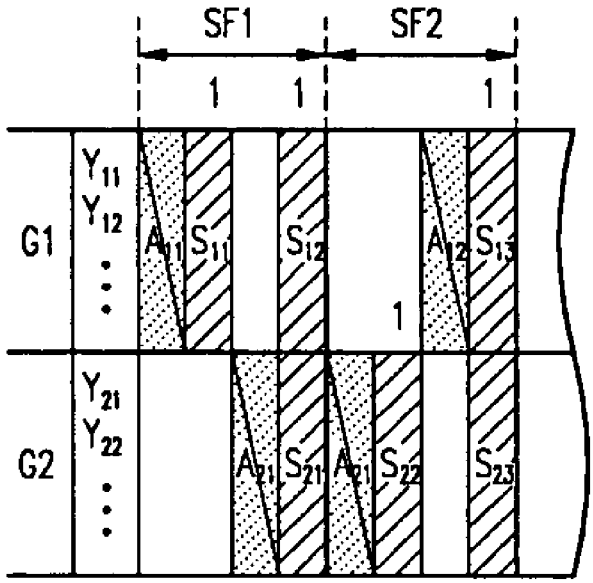
FIG. 3B is a table showing gradation weights allocated to groups during the subfields of FIG. 3A.
FIG. 4 illustrates a method for achieving 4 grades using two subfields.

FIG. 3B is a table showing gradation weights allocated to the groups during each subfield of FIG. 3A. As described above, gradation weights of 4, 2, 1, and 1 are allocated to the first through fourth sustain periods, respectively.

As shown in FIG. 3B, during the first subfield SF1, the first, second, third, and fourth groups G1, G2, G3, and G4 are assigned gradation weights of 8, 4, 2, and 1, respectively. In each of the other subfields, different gradation weights are allocated to the respective groups. Hence, one of grades 0 to 15 can be obtained by performing addressing on some of the groups G1 through G4 in each of the subfields SF1 through SF4. For example, in order to obtain grade 6, only the second and third groups undergo address periods during the first subfield SF1, only the third and fourth groups undergo address periods during the second subfield SF2, only the first and fourth groups undergo address periods during the third subfield SF3, and only the first and second groups undergo address periods during the fourth subfield SF4.

FIG. 4 illustrates a method of achieving 4 grades, which are grades 0, 1, 2, and 3, using two subfields. In a conventional method, different gradation weights are allocated to the first and second subfields SF1 and SF2 so that they represent grades 1 and 2, respectively. In FIG. 4, two sustain periods occur during one subfield, and weights are allocated to the two sustain periods so that each of the two sustain periods achieves grade 1.

During the first subfield SF1, an address period $A_{11}$ occurs on the pixels of the first group G1 and is followed by a first sustain period $S_{11}$ on the same pixels. Next, an address period $A_{21}$ occurs on the pixels of the second group G2 and is followed by a second sustain period $S_{21}$ on the same pixels. During the second sustain period $S_{21}$, a second sustain period $S_{12}$ also occurs on the pixels of the first group G1.

The first subfield SF1 is followed by the second subfield SF2, which starts with an address period $A_{22}$ and a first sustain period $S_{22}$ on the pixels of the second group G2. Next, an address period $A_{12}$ occurs substantially simultaneously on the pixels of the first group G1, and then second sustain periods $S_{13}$ and $S_{23}$ occur on the pixels of the first and second groups G1 and G2, respectively.

Hence, if the pixels of some of the groups are selectively addressed and sustain-discharged during each of the two subfields, one of grades 0 to 3 can be obtained.

Figures 5A, 5B:
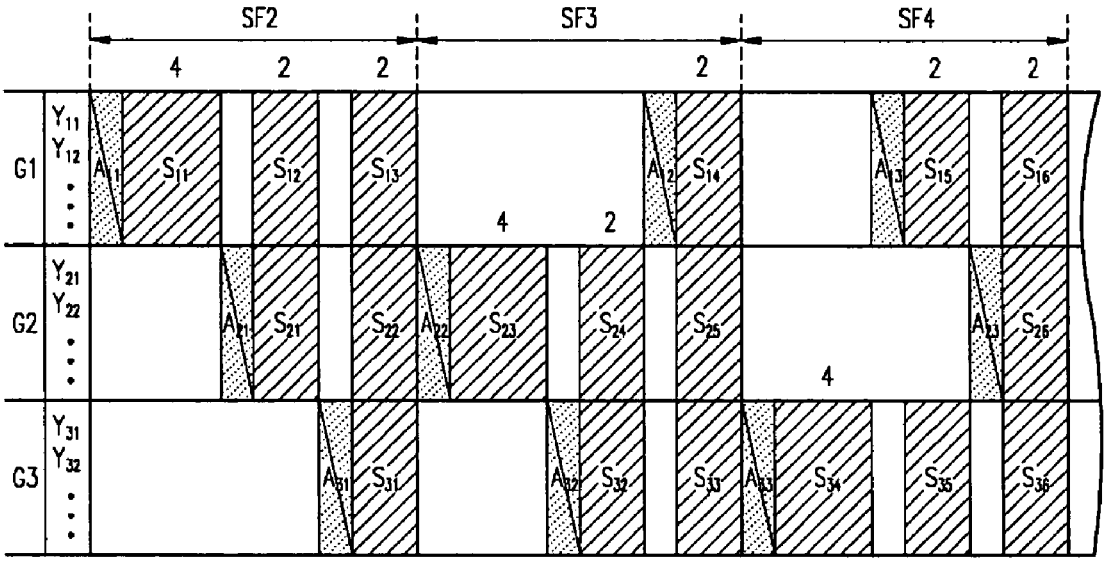
FIG. 5A illustrates a method for achieving 8 grades using three subfields.
FIG. 5B is a table showing gradation weights allocated to groups during the subfields of FIG. 5A.

FIG. 5A illustrates a method of achieving 8 grades using three subfields. In the aforementioned grade achieving methods, a plurality of subfields include the first subfield SF1, which is used to represent the lowest weight of 1. However, in FIG. 5A, three subfields excluding the first subfield SF1, which are second through fourth subfields SF2 through SF4, are used to obtain 8 grades, i.e., grades 0, 2, 4, . . . , and 14. If the first subfield SF1 representing grade 1 is combined into the three subfields, 16 grades, i.e., grades 0 to 15, can be obtained. In FIG. 5A, three sustain periods to which different weights are assigned so as to represent grades 4, 2, and 2, respectively, occur during each subfield.

During the second subfield SF2, first, an address period $A_{11}$ occurs on the pixels of the first group G1 and is followed by a first sustain period $S_{11}$ on the same pixels. Next, an address period $A_{21}$ occurs on the pixels of the second group G2 and is followed by a second sustain period $S_{21}$ on the same pixels. During the second sustain period $S_{21}$, a second sustain period $S_{12}$ also occurs on the pixels of the first group G1. Thereafter, an address period $A_{31}$ occurs substantially simultaneously on the pixels of the third group G3, and then third sustain periods $S_{13}$, $S_{22}$, and $S_{31}$ occur simultaneously on the pixels of the first through third groups G1 through G3, respectively.

During the third subfield SF3, address periods $A_{22}$, $A_{32}$, and $A_{12}$ occur on the groups in the sequence of G2, G3, and G1. Gradation weights of 4, 2, and 2 are allocated to sustain periods $S_{23}$, $S_{32}$, and $S_{14}$, respectively, that follow the address periods $A_{22}$, $A_{32}$, and $A_{12}$, respectively.

The third subfield SF3 is followed by a fourth subfield SF4. During the fourth subfield SF4, address periods $A_{33}$, $A_{13}$, and $A_{23}$ occur on the groups in the sequence of G3, G1, and G2. Gradation weights of 4, 2, and 2 are allocated to sustain periods $S_{34}$, $S_{15}$, and $S_{26}$, respectively, that follow the address periods $A_{33}$, $A_{13}$, and $A_{23}$, respectively.

FIG. 5B is a table showing the gradation weights allocated to the groups during each subfield of FIG. 5A. In FIG. 5A, gradation weights of 4, 2, and 2 are allocated to the first, second, and third sustain periods, respectively. Hence, during the second subfield SF2, gradation weights of 8, 4, and 2 are allocated to the groups G1, G2, and G3, respectively.

According to the conventional panel driving method of FIG. 1, one frame period is divided with time into n subfields, and then each of the n subfields is assigned a predetermined weight. During one frame, a desired gradation level is achieved by selectively operating either some or all of the subfields. During each subfield, an identical weight is allocated to all of the pixels of a panel. For example, in order to obtain 256 grades, one frame is divided into 8 subfields, and gradation weights of 1, 2, 4, . . . , and 128 are allocated to the 8 sub fields, respectively.

In the present invention, at least two among all of the subfields that form one frame are grouped as one set, and the subfields belonging to the set are driven in such a way as described in FIGS. 2A and 5A, while the other subfields can be driven according to a conventional panel-driving method, such as, the panel driving method disclosed in U.S. Pat. No. 5,541,618.

Figure 6:
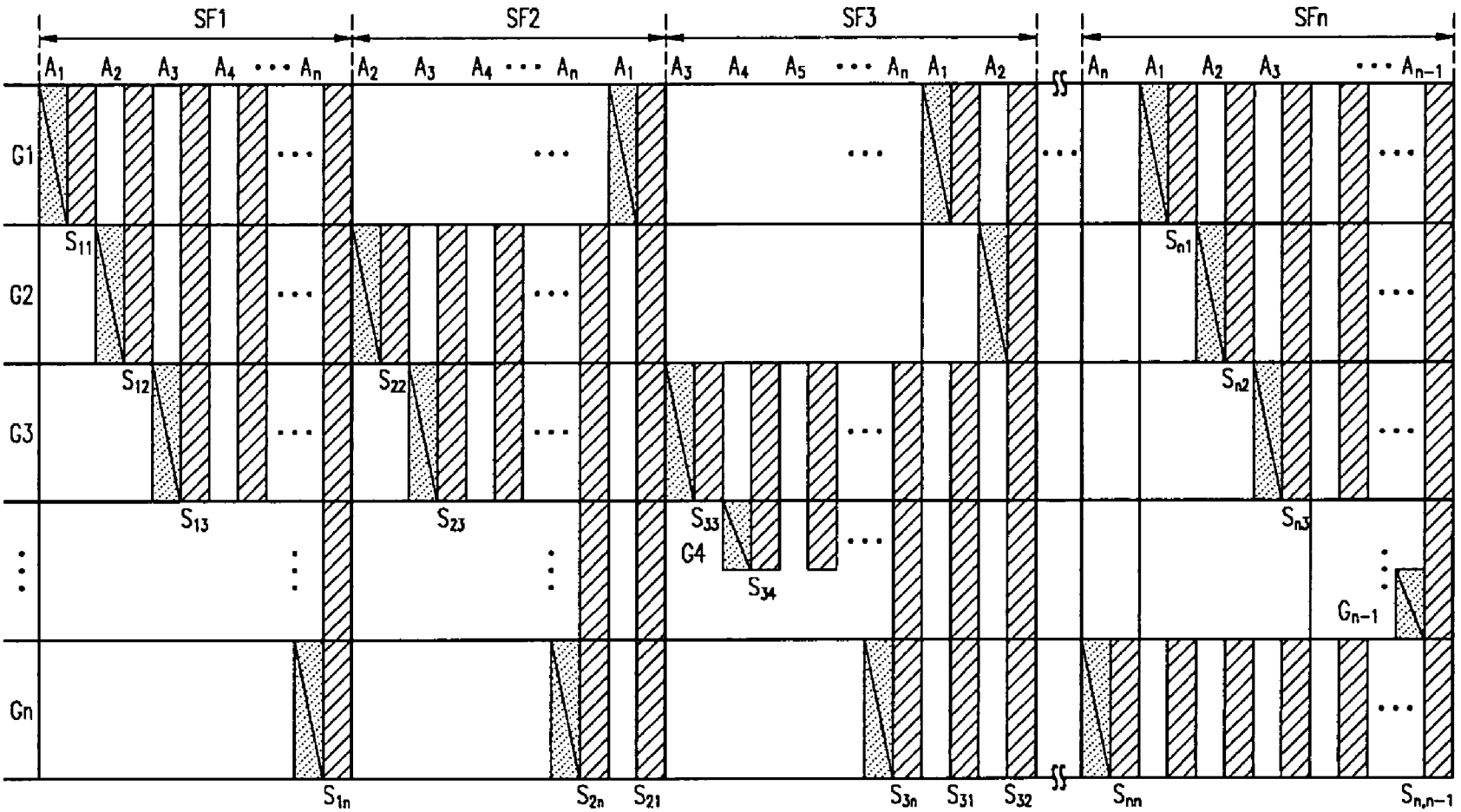
FIG. 6 illustrates a generalized panel driving method according to the invention.

FIG. 6 is a general view of a panel driving method according to the present invention. Looking at the time relationship between an address period and a sustain period, they are mixed during one subfield. In other words, the pixels of each group undergo a sequence of an address period and a sustain period. After one group undergoes an address period and a sustain period, another address period starts on the pixels of another group. While the pixels of one group are undergoing a sustain period, the pixels of other groups that have already undergone addressing periods also undergo sustain periods.

During the first subfield SF1, an address period $A_1$ is executed by applying scan pulses to the scan lines of the first group G1 in sequence of the first to the last scan lines. When the pixels of the first group G1 are completely addressed, they undergo a first sustain period $S_{11}$, during which the addressed pixels are sustain-discharged using a predetermined number of sustain pulses.

When the first sustain period $S_{11}$ for the first group G1 is terminated, an address period $A_2$ is executed on the pixels of the second group G2. In an exemplary embodiment of the invention, during the address period $A_2$ with respect to the second group G2, no operating pulses are applied to the pixels of the other groups.

When the address period $A_2$ with respect to the second group G2 is terminated, that is, when the pixels of the second group G2 is completely addressed, a second sustain period $S_{12}$ is executed on the second group G2. At this time, the first group G1 that have already been addressed also undergoes the second sustain period $S_{12}$. Of course, the pixels of groups that have not yet been addressed are kept idle.

When the second sustain period $S_{12}$ is completed, an address period $A_3$ and a third sustain period $S_{13}$ are executed on the third group G3 in the above-described way. While the third group G3 is undergoing the third sustain period $S_{13}$, the pixels of the first and second groups that have already been addressed also undergo the third sustain period S13.

Finally, an address period $A_n$ is executed on the last group Gn by sequentially applying scan pulses to the scan electrodes of the last group Gn, and then an n-th sustain period $S_{1n}$ is executed on the last group Gn. While the last group Gn is undergoing the n-th sustain period $S_{1n}$, the pixels of the groups that have already been addressed also undergo the n-th sustain period $S_{1n}$. When the n-th sustain period $S_{1n}$ with respect to all of the pixels is terminated, the operation of the first subfield SF1 is completed, and then the second subfield SF2 starts with a reset period (not shown).

The way of determining gradation weights to be allocated to first through n-th sustain periods that occur during each subfield will now be described in detail.

One frame is divided into 8 subfields, and gradation weights of 1, 2, 4, . . . , and 128 are allocated to the 8 subfields, respectively, to achieve 256 grades. It is assumed that n subfields selected from the 8 subfields are indicated by SF1 through SFn, and that weights allocated to the subfields SF1 through SFn are W1, W2, . . . , Wk, . . . , and Wn. If third through fifth subfields are selected, W1, W2, and W3 are 4, 8, and 16, respectively.

To achieve the invention by using n subfields, the pixels of a panel are classified into n groups. During one subfield, n address periods and n sustain periods occur. The first through n-th sustain periods are assigned n gradation weights given by Equation 1:

$$W_1 \text{ for } i=1$$

$$W_i - W_{1-1} \text{ for } 2 \leqq i \leqq n (n \geqq 2) \tag{1}$$

During one subfield, n groups, which range from a group that undergoes one sustain period to a group that undergoes n sustain periods, are processed. For example, the first group G1 undergoes all of the n sustain periods, and the second group G2 undergoes the sustain periods excluding a first sustain period. As the group number increases by 1, the number of sustain periods executed decreases by 1. Accordingly, the n-th group Gn undergoes an n-th sustain period.

When the pixels of the first group G1 have been addressed during the address period $A_1$ in the first subfield SF1, a grade that can be represented by the first subfield SF1 is calculated as in Equation 2:

$$W_{G1} = W_1 + \sum_{i=2}^{n} (W_i - W_{i-1}) = W_n \tag{2}$$

Then, when the second and third groups G2 and G3 undergo (n−1) and (n−2) sustain periods, respectively, they can represent grades as shown in Equation 3:

$$W_{G2} = W_1 + \sum_{i=2}^{n-1} (W_i - W_{i-1}) = W_{n-1} \tag{3}$$

$$W_{G3} = W_1 + \sum_{i=2}^{n-2} (W_i - W_{i-1}) = W_{n-2}$$

In this way, the groups Gn-2, Gn-1, and Gn are assigned weights $W_{Gn-2}$, $W_{Gn-1}$, and $W_{Gn}$ given by Equation 4:

$$W_{G_{n-2}} = W_1 + \sum_{i=2}^{3} (W_i - W_{i-1}) = W_3 \tag{4}$$

$$W_{G_{n-1}} = W_1 + \sum_{i=2}^{2} (W_i - W_{i-1}) = W_2$$

$$W_{Gn} = W_1$$

Hence, during one subfield, n groups can be assigned W1, W2, . . . , and Wn, respectively.

During the second subfield SF2, an address period $A_2$ is first executed on the second group G2, and the third through n-th groups G3 through Gn sequentially undergo a series of an address period and a sustain period. Then, the first group G1 undergoes an address period $A_1$, and then all of the groups G1 through Gn undergo an n-th sustain period. In this way, subsequent subfields are formed. During the n-th subfield SFn, an address period $A_n$ is first executed on the n-th group Gn, and then a series of an address period and a sustain period is executed on the other groups in the sequence of from G1 to Gn−1.

When the subfields SF1 through SFn are terminated in the above-described way, n, 1, 2, . . . , and (n−1) sustain periods are executed on the first group G1 during the subfields SF1 through SFn, respectively. (n−1), 1, 2, . . . , and (n−2) sustain periods are executed on the second group G2 during the subfields SF1 through SFn, respectively. Similarly, 1, 2, . . . , and n sustain periods are executed on the n-th group Gn during the subfields SF1 through SFn, respectively.

Hence, weights of Wn, W1, W2, . . . , and Wn−1 are allocated to the first group G1 during the first to n-th subfields SF1 through SFn, respectively. Weights of Wn−1, Wn, W1, W2, . . . , and Wn−2 are allocated to the second group G2 during the first to n-th subfields SF1 through SFn, respectively. Similarly, weights of W1, W2, . . . , and Wn are allocated to the n-th group Gn during the first to n-th subfields SF1 through SFn, respectively. Accordingly, a typical gradation-representing method can be implemented in such a subfield structure as shown in FIG. 6. In the prior art, during each subfield, an identical weight is allocated to all pixels. However, in the invention, during each subfield, different weights are applied to groups.

In the classification of the pixels of a panel into a plurality of groups, the number of scan electrodes included in each group may be equal or different.

The classification of the scan electrodes into a plurality of groups can be achieved according to a physical sequence in which the scan electrodes are arranged. If a panel is formed of 800 scan lines, and the 800 scan lines are classified into 8 groups, the first through hundredth scan lines may be classified into a first group, and the $101^{st}$ to $200^{th}$ scan lines may be classified into a second group. However, instead of grouping adjacent scan lines as described above, scan lines that are apart from one another at regular intervals may be grouped. For example, the first, ninth, seventeenth, . . . , and (8k+1)th scan lines may be collected in the first group, and second, tenth, eighteenth, . . . , and (8k+2)th scan lines may be collected in the second group. In some cases, the scan lines may be grouped in an irregular collection way.

In the case where not-adjoining scan lines are grouped, when a sustain period subsequent to an address period occurs on the scan electrodes of one group, a priming effect is generated due to the sustain period, so that charges move to scan lines adjacent to the scan electrodes that undergo the sustain period. The charges can help later addressing with respect to the adjacent scan lines. For example, if the first group has undergone an address period and a sustain period, charges are generated in the second, tenth, . . . , and (8k+2)th scan lines adjacent to the first group, due to the priming effect caused by discharging of the first, ninth, . . . , and (8k+1)th scan lines of the first group. Hence, when an address period occurs on the second group, the scan lines of the second group can be more securely addressed.

FIG. 9 is a block diagram of an apparatus which performs the above-described panel driving method according to the invention. The pixels of the panel 97 are addressed and sustained according to a panel driving method of the present invention, by using the pulse synthesis unit 94 and the Y (scan electrode) driving unit 96.

In the panel driving apparatus according to the invention, the pixels of the panel 97 are classified into a plurality of groups, and the pixels of each group are addressed and sustain-discharged. The pulse synthesis unit 94 executes a sequence of an address period and a sustain period on the pixels of each group during at least two of a plurality of subfields. The pulse synthesis unit 94 generates an address signal and a sustain signal so that, while the pixels of one group are undergoing an address period, the pixels of the other groups remain idle, and while the pixels of one group are undergoing a sustain period after an address period, the pixels of groups that have already been addressed may also undergo the sustain period.

The Y (scan electrode) driving unit 96 executes an address period by applying scan pulses to the scan lines of each group (at this time, applying address pulses to address electrodes) and then executes a sustain period by applying sustain pulses to the scan lines, so that the panel is driven in such a way that an address period and a sustain period are mixed. The X (sustain electrode) driving unit 95 applies sustain pulses to sustain electrodes while the pixels of each group are undergoing a sustain period.

When a predetermined grade wants to be achieved by a combination of n weights W1 through Wn, the n weights are allocated to n groups on a one-to-one basis during each subfield. In each group, the n weights are allocated to n subfields on a one-to-one basis. One subfield includes a plurality of sustain periods that are separated from one another in terms of time. A gradation weight allocated to each of the sustain periods is given by: $W_1$ (i=1), $W_i - W_{i-1}$ ($i \geqq 2$).

During the execution of a reset period, in an exemplary embodiment of the invention, all groups may concurrently undergo a reset period before the pixels of the first group undergo an address period. Alternatively, in another exemplary embodiment of the invention the groups may undergo individual reset periods before they undergo their address periods.

A panel driving method according to the invention is applicable to displays that execute a sequence of an address period, during which cells to be lit later are selected from all cells, and a sustain period, during which the selected cells are lit. For example, it should be apparent to those skilled in the art that the technical spirit of the invention can be applied without change to displays that display a picture by executing a sequence of an address period and a sustain period using space charges, such as, to DC type PDPs, electroluminescent (EL) displays, and liquid crystal displays, as well as AC type PDPs.

The invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, floppy disks, optical data storage devices, and so on. The program recorded in such a recording medium is composed of a series of instructions that are used directly or indirectly within a device with an information processing capability, such as, a computer, to obtain a specific result. Hence, the term "computer" can be interpreted as any device with an information processing capability that includes a memory, an input/output device, and arithmetic devices in order to perform a specific function using a program. As for the term "a panel driving apparatus", only its purpose is limited to the field of panel driving, but the panel driving apparatus can be considered a computer in essence.

A pulse synthesis unit included in a panel driving apparatus as described above may be implemented as an integrated circuit that includes a memory and a processor, and accordingly can store a program for implementing a panel driving method in the memory. Upon panel driving, the pulse synthesis unit can execute an addressing operation and a sustaining operation according to the present invention by executing the program stored in the memory. Thus, the integrated circuit that stores the program for implementing a panel driving method must be interpreted as a recording medium as described above.

While the invention has been particularly shown and described with reference to exemplary embodiments thereof, it will be understood by those of ordinary skill in the art that various changes in form and details may be made therein without departing from the spirit and scope of the present invention as defined by the following claims.

In a panel driving method and a panel driving apparatus according to the invention as described above, when gradation is represented in a frame-subfield structure, the pixels of a panel may be classified into a plurality of groups, and an address period and a sustain period consecutively occur on each of the groups during each subfield. Accordingly, sustain discharging occurs shortly after addressing each of the pixels, so that stable sustain discharging can be achieved even though the widths of scan and address pulses applied upon address periods are made narrower. Thus, the time required to address all of the pixels is reduced, and accordingly, more time can be allocated to sustain discharging during one TV field. Therefore, the brightness of a screen can be improved, and it is possible to embody an apparatus that can provide a high gradation even on a large panel having more scan lines. Also, the invention provides an adaptable panel-driving method used to represent gradation.

What is claimed is:

1. A panel driving apparatus comprising:

a subfield processor which divides one frame into a plurality of subfields and during each subfield, allocates different gradation weights to a plurality of groups into which the pixels of a panel are classified, during each subfield, while gradation weights allocated to the groups during one frame are same;

a signal synthesis unit which generates an address signal for addressing only pixels to be lit later among the pixels and a sustain signal for sustain-discharging the addressed pixels, wherein the address signal and the sustain signal are applied during each of the subfields; and a pixel driving unit which selectively drives the pixels of the groups during each subfield depending on the address and sustain signals output from the signal synthesis unit, to determine a gradation of visual brightness of each of the pixels, wherein:

while executing an address period on the pixels of one group during a subfield, the signal synthesis unit renders the pixels of the other groups to be idle, while executing a sustain period on the pixels of one group, the signal synthesis unit executes a sustain period on the pixels of groups that have already been addressed, and the signal synthesis unit determines a gradation for each pixel according to gradation weights allocated to the addressed subfields by selectively performing an address period with respect to the individual groups.

2. The panel driving apparatus of claim 1, wherein to represent a gradation for each cell using a combination of n weights $W_1$ through $W_n$, each group is assigned one of the n weights during one subfield, and the n subfields in each group are assigned the n weights on a one-to-one basis.

3. The panel driving apparatus of claim 1, wherein one subfield includes a plurality of sustain periods that are temporally separated from one another, and a gradation weight allocated to each of the sustain periods is given by: W1 (i=1), $W_i-W_{i-1}$ (i≧2).

4. The panel driving apparatus of claim 1, wherein all of the plurality of groups simultaneously undergo a reset period before the first group undergoes an address period, or each of the plurality of groups separately undergoes a reset period before each group undergoes an address period.

5. The panel driving apparatus of claim 1, wherein the pixels are classified into a plurality of groups such that a predetermined number of consecutive pixels are grouped together or a predetermined number of pixels separated at regular intervals are grouped together.

6. A panel driving method for representing a gradation for each cell, wherein pixels of a panel are classified into a plurality of groups, one frame period is divided with time into n subfields, an address period and a sustain period sequentially occur during each of the subfields, and n gradation weights W1 through Wn (where n is an integer equal to or greater than 2) are allocated to the sustain periods in the n subfields, respectively, the panel driving method comprising:

assigning, during one subfield, any one of the n weights to each of the groups when at least two of the n weights are different;

assigning, during one frame, the n weights to the n subfields in each group, respectively;

keeping the pixels of the other groups idle while the pixels of one group are undergoing an address period during a subfield;

subjecting the pixels of groups that have already been addressed to the sustain period, while the pixels of one group are undergoing a sustain period; and determining a gradation for each pixel according to gradation weights allocated to the addressed subfields by selectively performing an address period with respect to individual groups.

7. The panel driving method of claim 1, wherein one subfield includes a plurality of sustain periods that are temporally separated from one another, and a gradation weight allocated to each of the sustain periods is given by: W1 (i=1), $W_i-W_{i-1}$ (i≧2).

8. The panel driving method of claim 1, wherein all of the plurality of groups simultaneously undergo a reset period before the first group undergoes an address period, or each of the plurality of groups separately undergoes a reset period before each group undergoes an address period.

9. The panel driving method of claim 1, wherein the pixels are classified into a plurality of groups such that a predetermined number of consecutive pixels are grouped or a predetermined number of pixels separated at regular intervals are grouped.

10. A panel driving method in which pixels of a panel are classified into a plurality of groups, and one frame period is divided with time into n subfields, the panel driving method comprising:

allocating during one subfield, different weights to the durality of groups;

allocating, during one frame, an identical total weight to each of the groups;

keeping the pixels of the other groups while the pixels of one group are undergoing an address period during a subfield;

subjecting the pixels of groups that have already been addressed to the sustain period, while the pixels of one group are undergoing a sustain period; and determine a gradation for each pixel is according to gradation weights allocated to the addressed subfields by selectively performing an address period with respect to individual groups.

11. The panel driving method of claim 10, wherein all of the plurality of groups simultaneously undergo a reset period before the first group undergoes an address period, or each of the plurality of groups separately undergoes a reset period before each group undergoes an address period.

12. The panel driving method of claim 10, wherein the pixels are classified into a plurality of groups such that a predetermined number of consecutive pixels are grouped together or a predetermined number of pixels separated at regular intervals are grouped together.

13. A panel driving method in which pixels of a panel are classified into a plurality of groups, and one frame period is divided with time into n subfields, the panel driving method comprising:

allocating during each subfield, different lengths of sustain periods or different numbers of sustain pulses to the group;

allocating, during one frame, an identical total length of a sustain period or an identical total number of sustain pulses to the groups;

keeping the pixels of the other groups idle, while the pixels of one group are undergoing an address period during a subfield;

subjecting the pixels of groups that have already been addressed also undergo the sustain period, while the pixels of one group are undergoing a sustain period; and a gradation for each pixel is determined according to gradation weights allocated to the addressed subfields by selectively performing an address period with respect to individual groups.

14. The panel driving method of claim 13, wherein all of the plurality of groups simultaneously undergo a reset period before the first group undergoes an address period, or each of the plurality of groups separately undergoes a reset period before each group undergoes an address period.

15. The panel driving method of claim 13, wherein the pixels are classified into a plurality of groups such that a predetermined number of consecutive pixels are grouped together or a predetermined number of pixels separated at regular intervals are grouped together.

* * * * *